US007028588B2

(12) United States Patent
Shih

(10) Patent No.: US 7,028,588 B2
(45) Date of Patent: Apr. 18, 2006

(54) TOOL HAVING EASILY IDENTIFIED SIZE

(76) Inventor: Leo Shih, No. 3 Jingcheng 7th St., Shi Chiu, Taichung (TW) 403

( * ) Notice: Subject to any disclaimer, the term of this patent is extended or adjusted under 35 U.S.C. 154(b) by 21 days.

(21) Appl. No.: 10/794,164

(22) Filed: Mar. 4, 2004

(65) Prior Publication Data

US 2005/0193874 A1 Sep. 8, 2005

(51) Int. Cl.
*B25B 13/02* (2006.01)

(52) U.S. Cl. ..... 81/121.1; 81/119; 81/DIG. 5

(58) Field of Classification Search ..... 81/121.1, 81/119, DIG. 5
See application file for complete search history.

(56) References Cited

U.S. PATENT DOCUMENTS 1,984,839 A * 12/1934 Murray ..... 116/200
2,161,163 A * 6/1939 Hedgpeth ..... 40/629
4,836,059 A * 6/1989 Arnold ..... 76/114
4,947,713 A * 8/1990 Arnold ..... 81/121.1
4,969,231 A * 11/1990 Mader et al. ..... 16/421
6,257,098 B1 * 7/2001 Cirone ..... 81/119
6,393,950 B1 * 5/2002 Crosser ..... 81/119
6,761,093 B1 * 7/2004 Chang ..... 81/121.1
6,792,831 B1 * 9/2004 Crosser ..... 81/119
2002/0139224 A1 * 10/2002 Crosser ..... 81/119
2004/0216566 A1 * 11/2004 Shih ..... 81/119
2005/0028651 A1 * 2/2005 Crosser ..... 81/180.1

FOREIGN PATENT DOCUMENTS

JP 03084582 A * 4/1991

* cited by examiner

*Primary Examiner*—David B. Thomas
(74) *Attorney, Agent, or Firm*—W. Wayne Liauh

(57) ABSTRACT

A tool comprises a surface area, the area being printed in one of two different first colors for identifying the tool as one labeled in either the British system or the metric system, and a numeral as a representation of a size of the tool disposed in the area, the numeral having a second color different from the first color of the area for providing a contrast of the numeral to other portions of both the area and the tool. The correct size of the tool thus can be quickly identified. Moreover, a number of embodiments are made possible.

11 Claims, 19 Drawing Sheets

B

A

D

C

F

E

H

G

J

I

TOOL HAVING EASILY IDENTIFIED SIZE

BACKGROUND OF THE INVENTION

1. Field of the Invention

The present invention relates to tools and more particularly to a tool having an arrangement for easily identifying a size thereof by different colors and other techniques.

2. Description of Related Art

Conventionally, a tool is classified by size of the metric system or the British system. It is typical for a user to visually identify the size of a tool. This is a time consuming process. Further, a user may not be able to easily locate and identify the correct size since both the size and the tool have the same color. For solving the above problem, a number of documents have been disclosed as detailed below.

A Taiwanese Patent Published No. 77,210,372 as shown in FIG. 1 disclosed a sleeve 10 having its size labeled in the metric system (or a sleeve 11 having its size labeled in the British system). An annular recess 101 is formed around the sleeve 10 and an annular recess 111 is formed around the sleeve 11 respectively. An annular band 102 of a first color is adhered on the recess 101 and an annular band 112 of a second color different from the first color is adhered on the recess 111 respectively. Thus, it is easy to distinguish the size of the metric system from the size of the British system. Further, band 102 of one size has a width different from that of the band of an adjacent size for being easily identified. However, width change technique is not practical because a user can hardly distinguish one size from an adjacent size due to very small width change therebetween. That is, width change can be observed only between a size and another distal size. Unfortunately, this is not necessary since a visual observation is sufficient. In fact, a correct size can be identified only by a visual observation on the color band by slowly turning the sleeve. Thus, the first prior art is not advantageous.

Another Taiwanese Patent Published No. 77,210,372A01 as shown in FIG. 2 is a continuation-in-part of the first prior art. The second prior art substantially has same structure as the first one. The characteristics of the second prior art are detailed below. For a sleeve 12, an annular band 122, having the same color as the color band 121 but having a width smaller than the color band 121, is adhered on an annular recess above the color band 121. Likewise, for a sleeve 13, an annular band 132, having the same color as the color band 131 but having a width smaller than the color band 131, is adhered on an annular recess above the color band 131. The provision of the color bands 122 and 132 aims at identifying odd and even numbered sizes of the metric system and ⅛" and 1/16" of the British system respectively. However, it is preferred to have a simple color band combination from a user's point of view. As such, the second prior art can cause confusion for an ordinary user. Thus, it is impractical. Moreover, it is important for a user to correctly identify the correct size. Unfortunately, the second prior art fails to achieve the above goal. In other words, it is unnecessary.

Still another Taiwanese Patent Published No. 92,205,833 is shown in FIG. 3. It disclosed color bands 161 and 171 printed around metal sleeves 16 and 17 respectively. On the color band 161 a rectangular area 162 having a color 163 different from that of the band 161 is formed. As shown, a numeral 22, as an example of the metric system, is formed on the area 162. Likewise, on the color band 171 a rectangular area 172 having a color 173 different from that of the band 171 is formed. As shown, a numeral ⅞", as an example of the British system, is formed on the area 172. It is easy to distinguish the sleeve 16 of the metric system from the sleeve 17 of the British system since the band 161 has a color different from that of the band 171. Next, it is possible of quickly, easily finding the area 162 (or 172) by identify the color 163 (or 173). This facilitates to read the correct size. However, such arrangement may be too complicated, resulting in an increase in the manufacturing cost. Thus, the need for improvement still exists.

SUMMARY OF THE INVENTION

It is an object of the present invention to provide a tool comprising an area disposed on an outer surface, the area being printed in one of two different first colors for identifying the tool as one labeled in either the British system or the metric system; and a numeral as a representation of a size of the tool disposed in the area, the numeral being a stencil so as to expose a metal color of the tool, wherein the numeral has a second color different from the first color of the area for providing a contrast of the numeral to other portions of both the area and the tool. By utilizing the present invention, it is possible of quickly identifying the correct size of the tool prior to use or storage.

It is another object of the present invention to provide a tool comprising an area disposed on an outer surface, the area being printed in one of two different first colors for identifying the tool as one labeled in either the British system or the metric system; and a numeral as a representation of a size of the tool disposed in the area, the numeral being a stencil and having a color different from the first color of the are printed therein so as to provide a contrast of the numeral to other portions of both the area and the tool. By utilizing the present invention, it is possible of quickly identifying the correct size of the tool.

It is still another object of the present invention to provide a tool comprising an enclosed embossment disposed on an outer surface, the embossment being printed in one of two different first colors for identifying the tool as one labeled in either the British system or the metric system; and a numeral as a representation of a size of the tool disposed in the area by printing, the numeral having a second color different from the first color of the embossment for providing a contrast of the numeral to other portions of both the area and the tool. By utilizing the present invention, it is possible of quickly identifying the correct size of the tool.

It is a further object of the present invention to provide a tool comprising an area disposed on an outer surface, the area being printed in one of two different first colors for identifying the tool as one labeled in either the British system or the metric system; a numeral as a representation of a size of the tool disposed in the area, the numeral having a second color different from the first color of the area for providing a contrast of the numeral to other portions of both the area and the tool; and a trademark being formed by cutting through the area or printing on the area, the trademark having a third color different from both the first color of the area and the second color. By utilizing the present invention, it is possible of quickly identifying the correct size of the tool and the trademark.

The above and other objects, features and advantages of the present invention will become apparent from the following detailed description taken with the accompanying drawings.

DETAILED DESCRIPTION OF THE PREFERRED EMBODIMENTS

Figure 1:
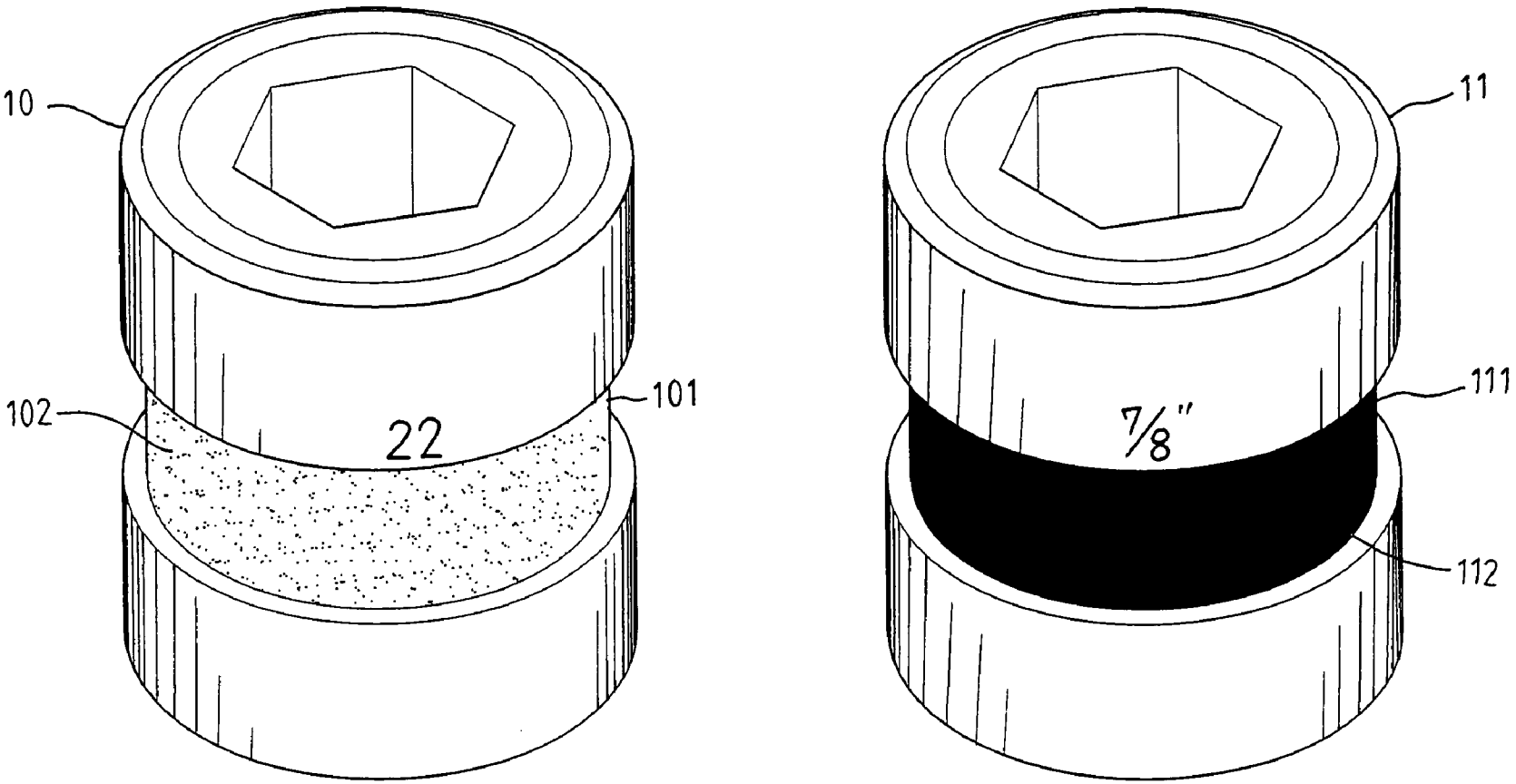
FIG. 1 PRIOR ART
FIG. 1 is a perspective view of two typical examples of tool having an arrangement for easily identifying a size thereof according to first prior art.
Figure 2:
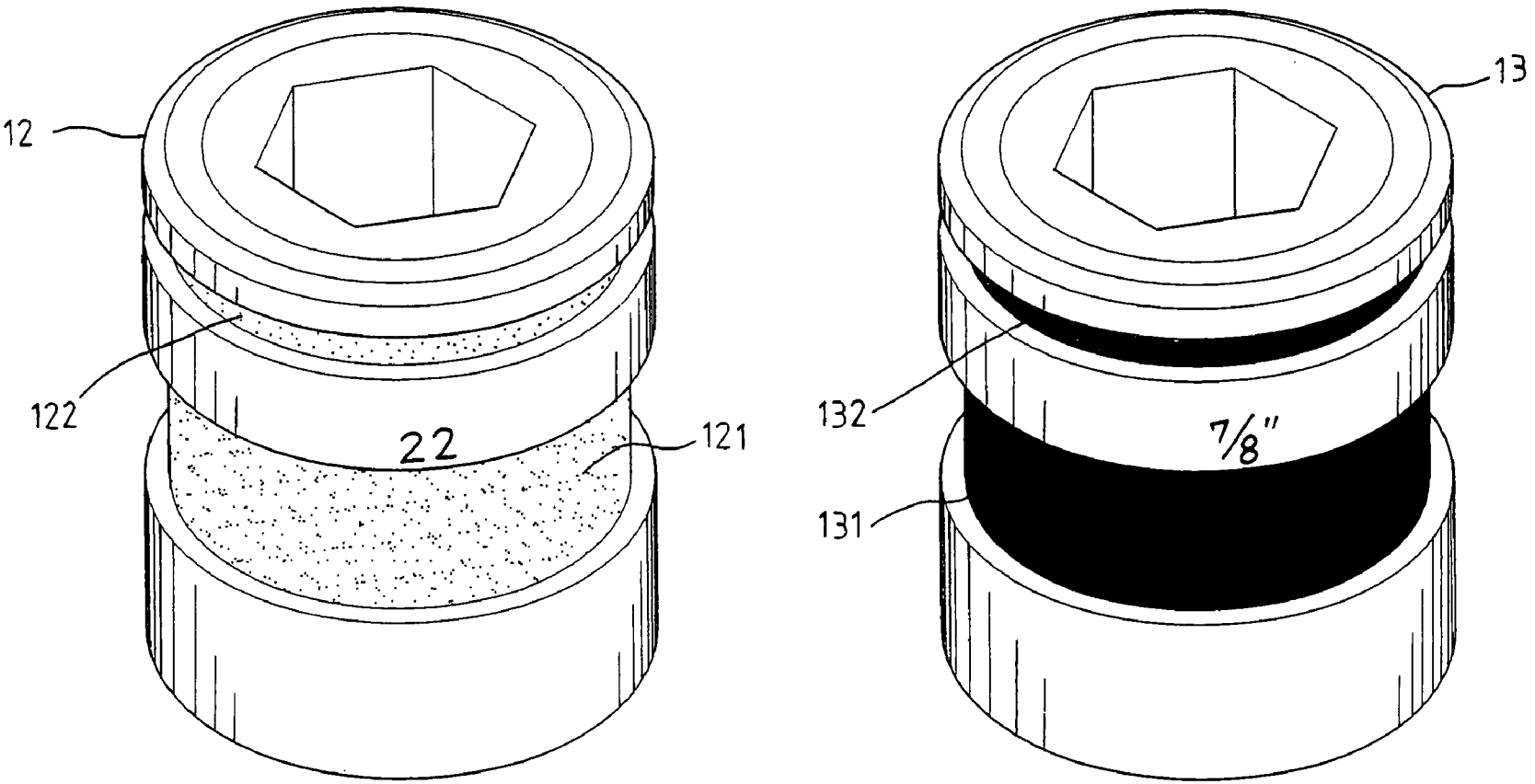
FIG. 2 PRIOR ART
FIG. 2 is a perspective view of two typical examples of tool having an arrangement for easily identifying a size thereof according to second prior art.
Figure 3:
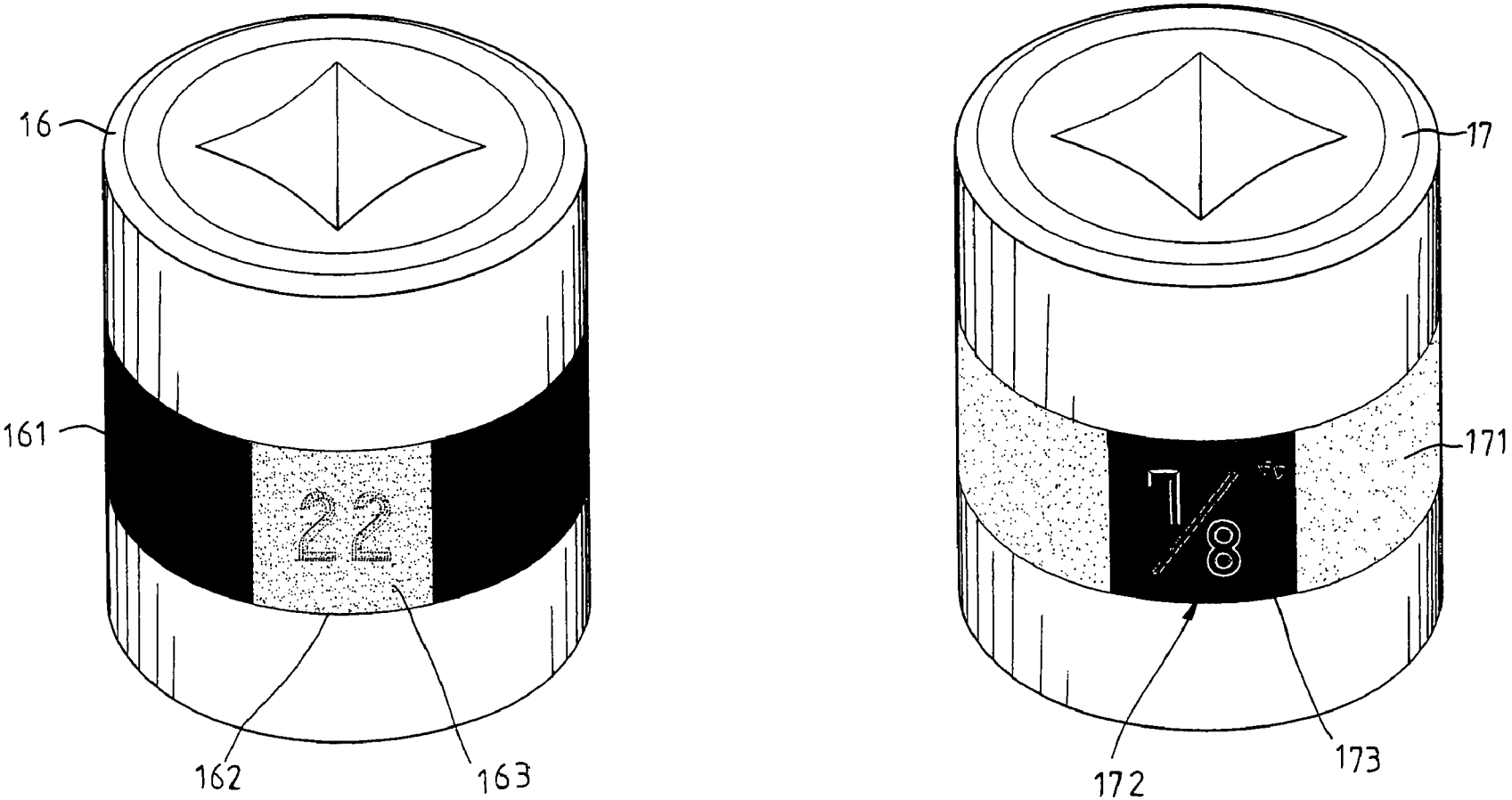
FIG. 3 PRIOR ART
FIG. 3 is a perspective view of two typical examples of tool having an arrangement for easily identifying a size thereof according to third prior art.
Figure 4:
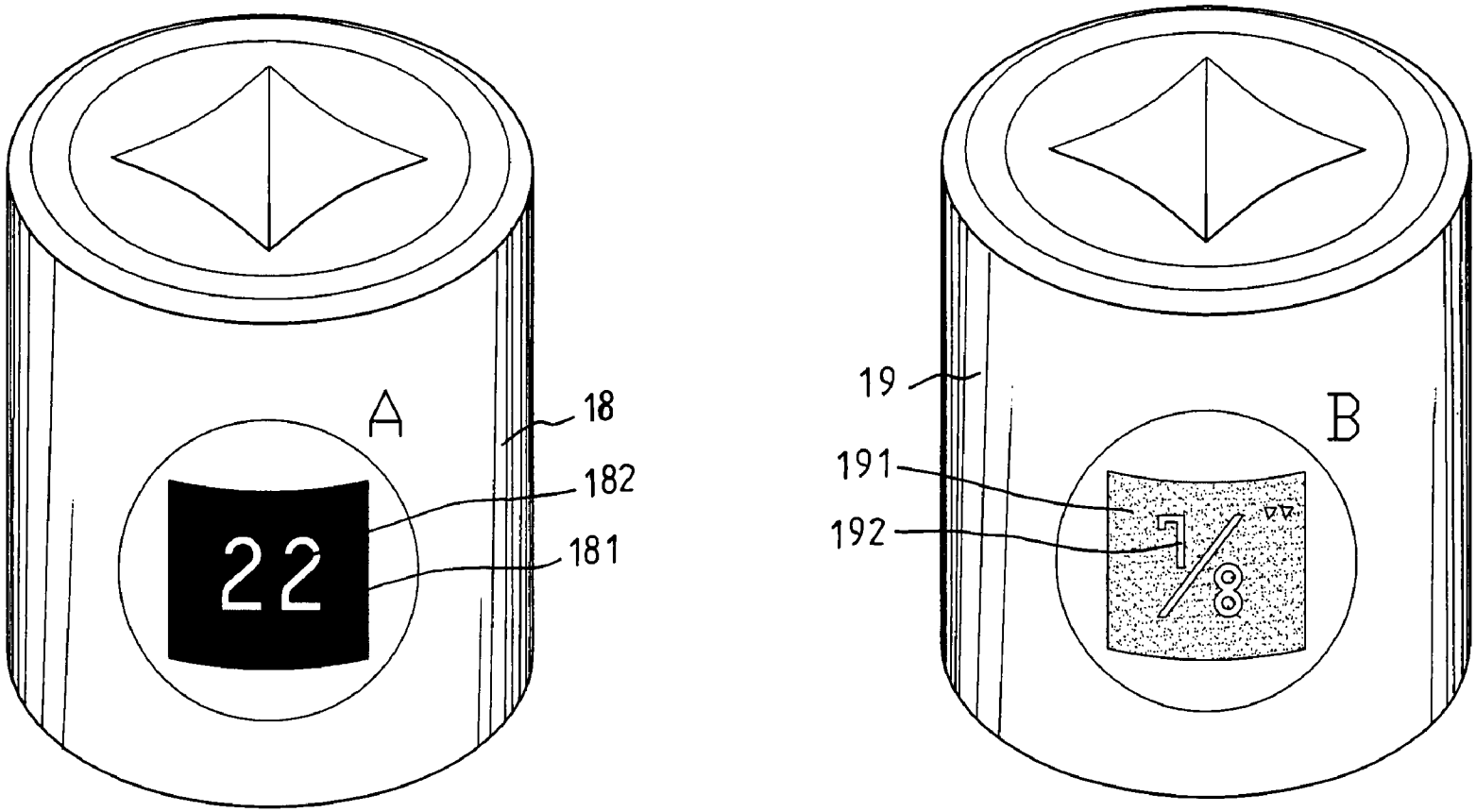
FIG. 4 is a perspective view of two exemplary examples of tool having an arrangement for easily identifying a size thereof according to a first preferred embodiment of the invention.
Figure 5:
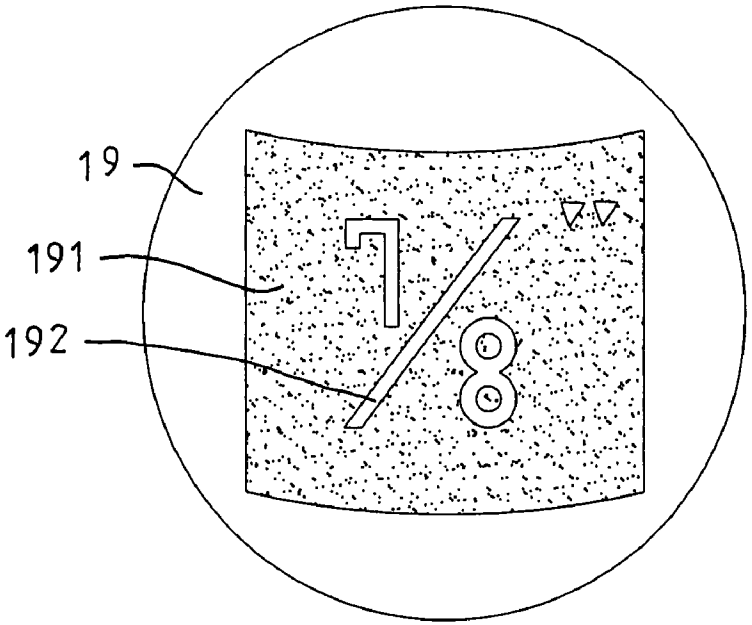
FIG. 5 is a detailed view of the areas in circles A and B in FIG. 4.
Figure 5:
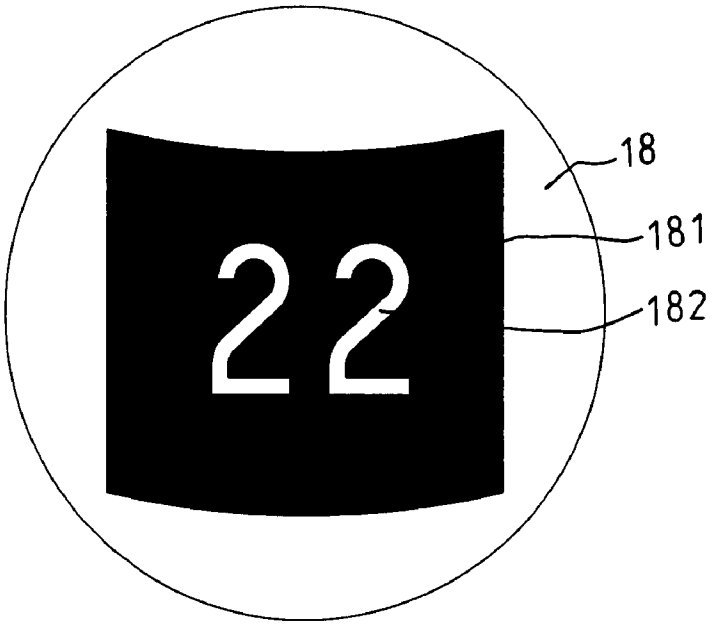

Referring to FIGS. 4 and 5, there is shown a tool (e.g., sleeve) having an arrangement for easily identifying a size thereof in accordance with a first preferred embodiment of the invention. A rectangular area 181 having a color different from that of the remaining portion of the sleeve 18 of the metric system is printed on an outer surface of the sleeve 18. A numeral 182 (e.g., 22 as shown) is formed by cutting through the rectangular area 181 so as to form a stencil for exposing the color of the metal sleeve 18 and providing a contrast of the numeral 182 to other portions of the sleeve 18. Likewise, A rectangular area 191 having a color different from that of the remaining portion of the sleeve 19 of the British system is printed on an outer surface of the sleeve 19. A numeral 192 (e.g., ⅞" as shown) is formed by cutting through the rectangular area 191 so as to form a stencil for exposing the color of the metal sleeve 19 and providing a contrast of the numeral 192 to other portions of the sleeve 19. The rectangular areas 181 and 191 have different colors. As such, a user not only can easily distinguish the sleeve 18 of the metric system from the sleeve 19 of the British system but also can quickly identify the correct size (e.g., the numeral) prior to use or storage.

Figure 6:
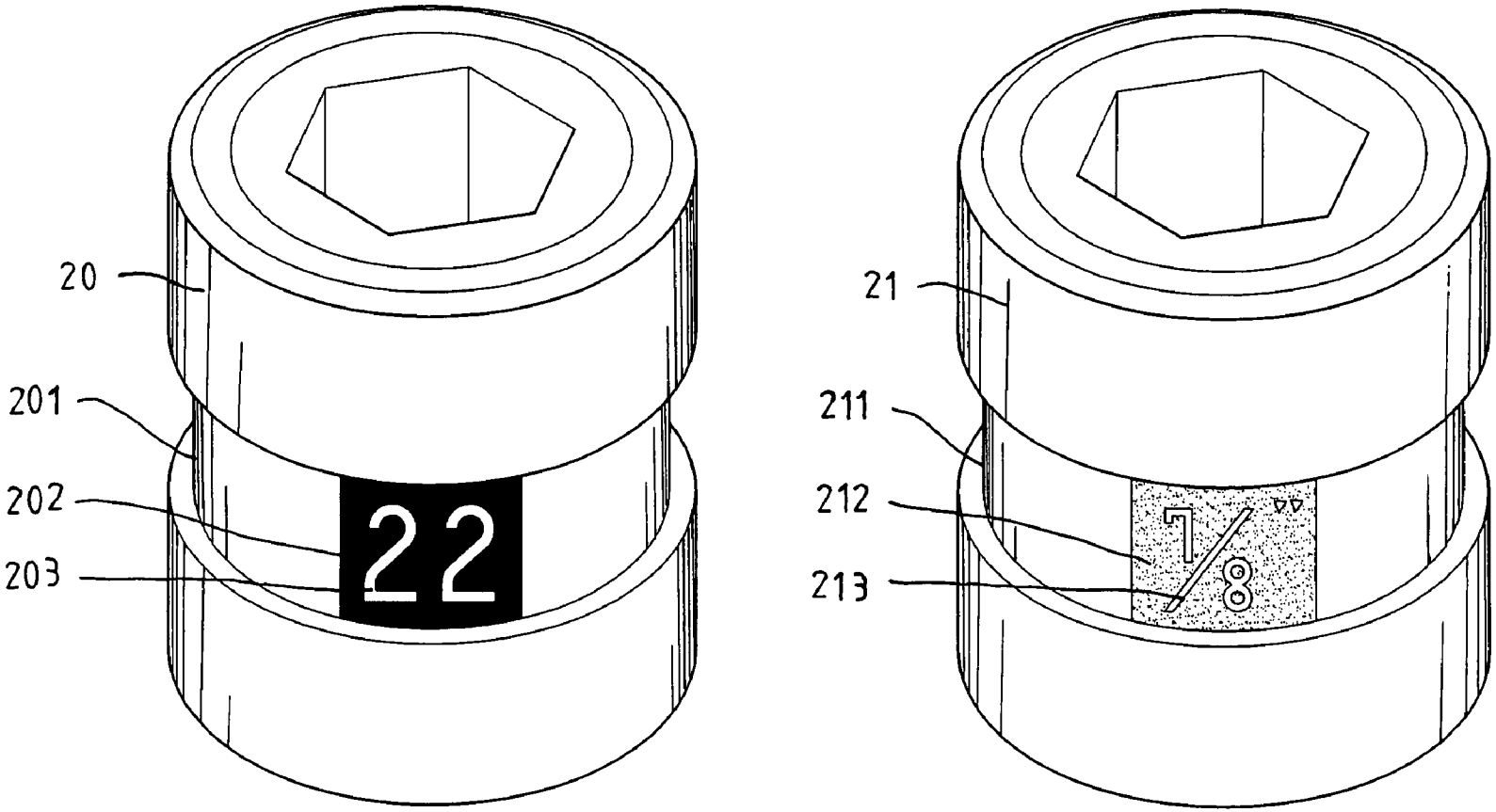
FIG. 6 is a perspective view of two exemplary examples of tool having an arrangement for easily identifying a size thereof according to a second preferred embodiment of the invention.

Referring to FIG. 6, there is shown a tool (e.g., sleeve) having an arrangement for easily identifying a size thereof in accordance with a second preferred embodiment of the invention. An annular recess 201 is formed around the sleeve 20 of the metric system. A rectangular area 202 having a color different from that of the remaining portion of the sleeve 20 is printed on a portion of the recess 201. A numeral 203 (e.g., 22 as shown) is formed by cutting through the rectangular area 202 so as to form a stencil for exposing and providing a contrast of the numeral 203 to other portions of the sleeve 20. Likewise, an annular recess 211 is formed around the sleeve 21 of the British system. A rectangular area 212 having a color different from that of the remaining portion of the sleeve 21 is printed on a portion of the recess 211. A numeral 213 (e.g., ⅞" as shown) is formed by cutting through the rectangular area 212 so as to form a stencil for exposing the color of the metal sleeve 21 and providing a contrast of the numeral 213 to other portions of the sleeve 21. The rectangular areas 202 and 212 have different colors. This embodiment has the same advantages as the above one.

Figure 7:
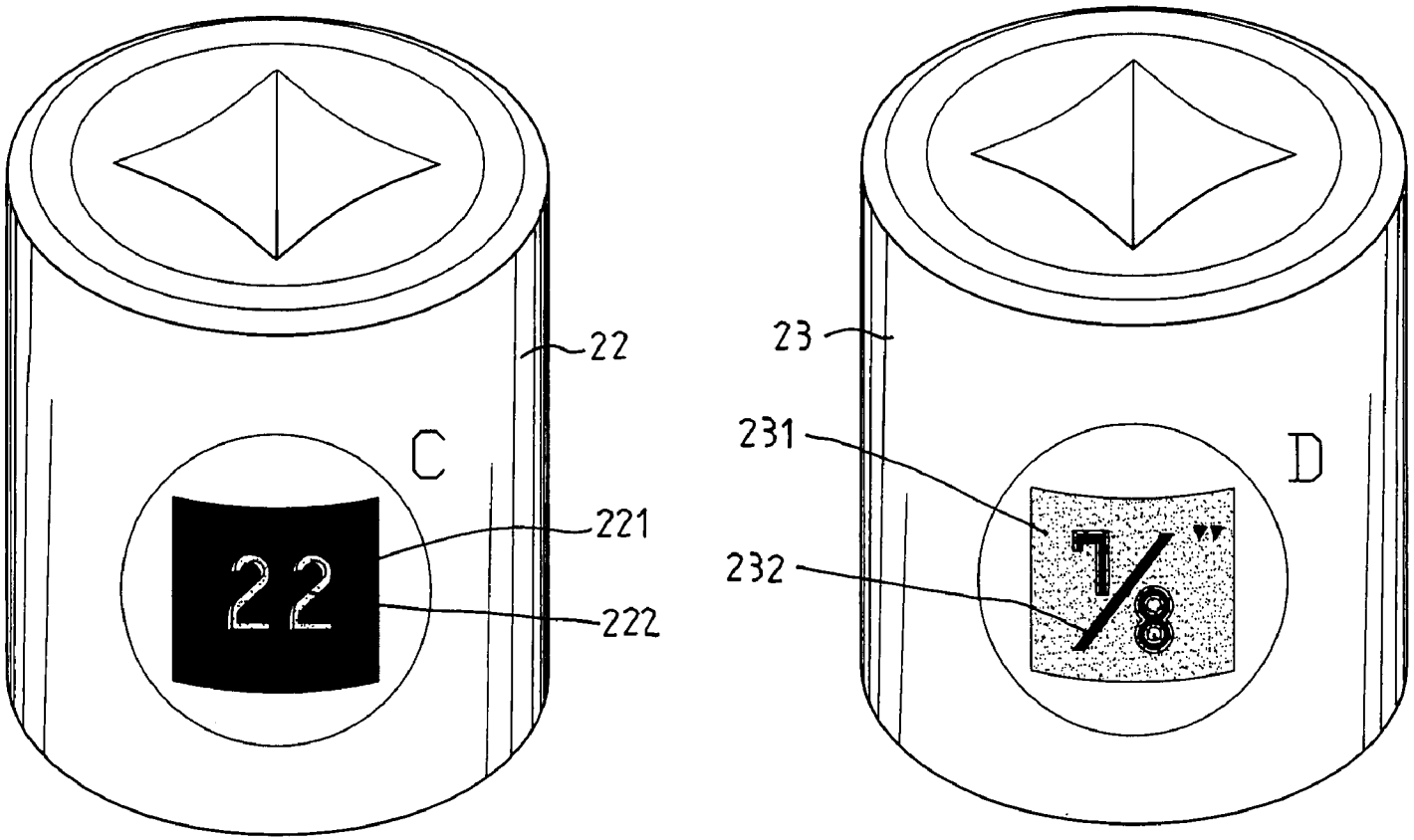
FIG. 7 is a perspective view of two exemplary examples of tool having an arrangement for easily identifying a size thereof according to a third preferred embodiment of the invention.
Figure 8:
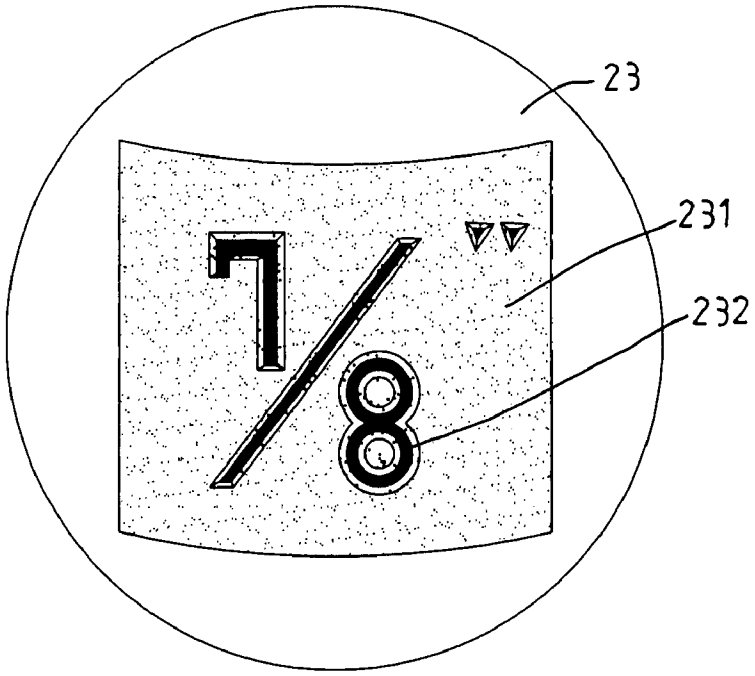
FIG. 8 is a detailed view of the areas in circles C and D in FIG. 7.
Figure 8:
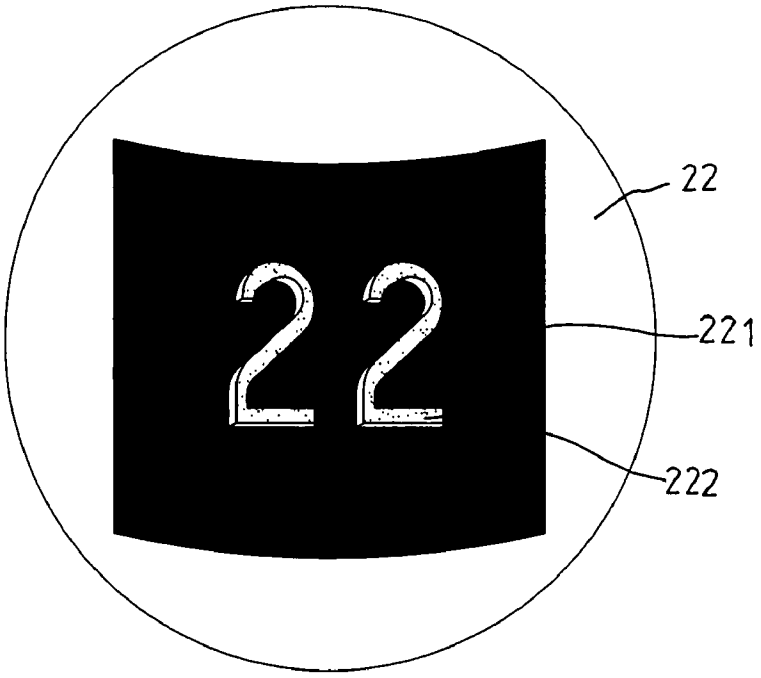

Referring to FIGS. 7 and 8, there is shown a tool (e.g., sleeve) having an arrangement for easily identifying a size thereof in accordance with a third preferred embodiment of the invention. A rectangular area 221 having a color different from that of the remaining portion of the sleeve 22 of the metric system is printed on an outer surface of the sleeve 22. A numeral 222 (e.g., 22 as shown) is formed by cutting through the rectangular area 221 so as to form a stencil. Further, color different from the color of the rectangular area 221 is printed on the numeral 222 so as to provide a contrast of the numeral 222 to other portions of the sleeve 22. Likewise, a rectangular area 231 having a color different from that of the remaining portion of the sleeve 23 of the British system is printed on an outer surface of the sleeve 23. A numeral 232 (e.g., ⅞" as shown) is formed by cutting through the rectangular area 231 so as to form a stencil. Further, color different from the color of the rectangular area 231 is printed on the numeral 232 so as to provide a contrast of the numeral 232 to other portions of the sleeve 23. This embodiment has the same advantages as the above one.

Figure 9:
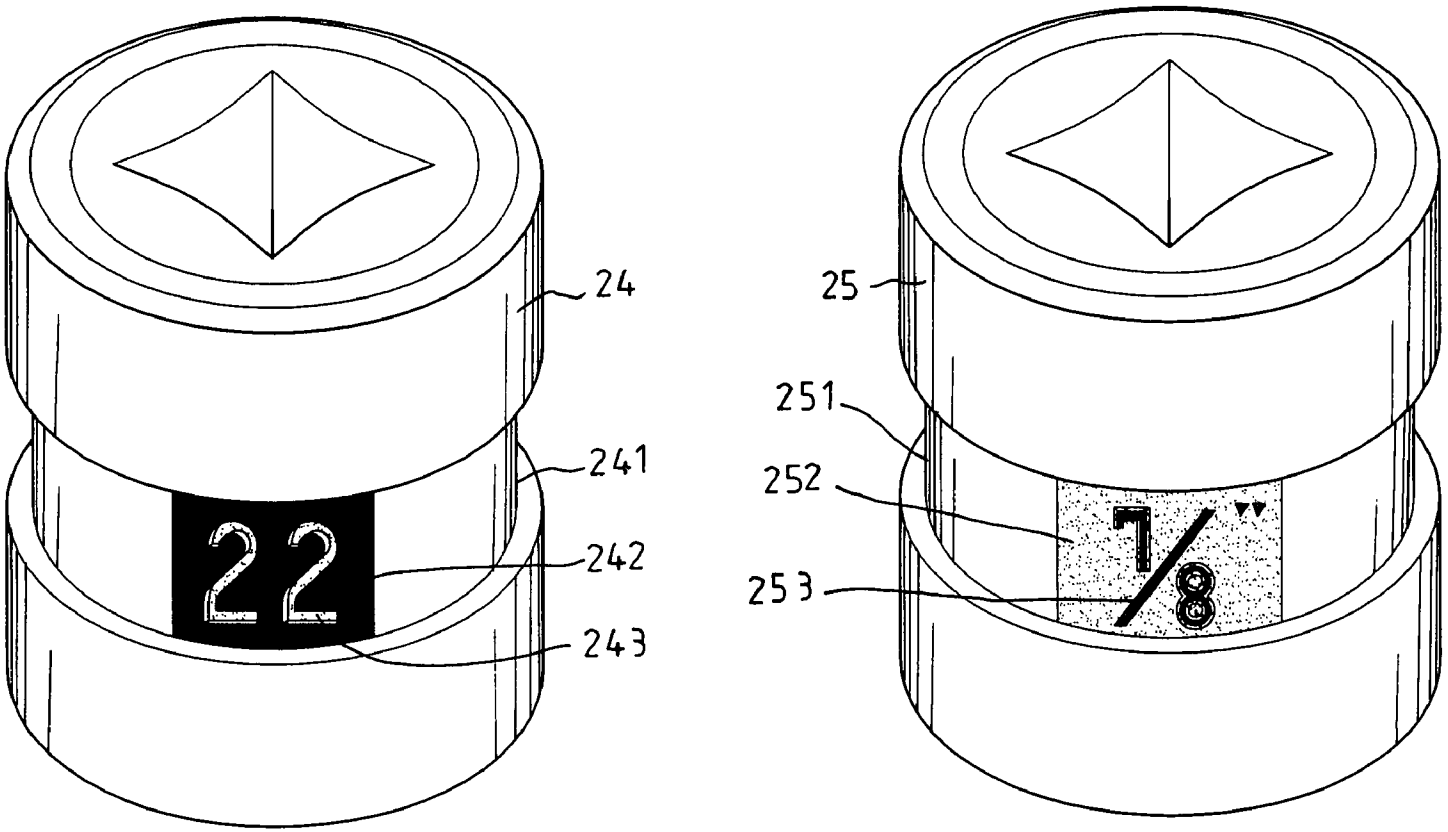
FIG. 9 is a perspective view of two exemplary examples of tool having an arrangement for easily identifying a size thereof according to a fourth preferred embodiment of the invention.

Referring to FIG. 9, there is shown a tool (e.g., sleeve) having an arrangement for easily identifying a size thereof in accordance with a fourth preferred embodiment of the invention. An annular recess 241 is formed around the sleeve 24 of the metric system. A rectangular area 242 having a color different from that of the remaining portion of the sleeve 24 is printed on a portion of the recess 241. A numeral 243 (e.g., 22 as shown) is formed by cutting through the rectangular area 242 so as to form a stencil. Further, color different from the color of the rectangular area 242 is printed on the numeral 243 so as to provide a contrast of the numeral 243 to other portions of the sleeve 24. Likewise, an annular recess 251 is formed around the sleeve 25 of the British system. A rectangular area 252 having a color different from that of the remaining portion of the sleeve 25 is printed on a portion of the recess 251. A numeral 253 (e.g., ⅞" as shown) is formed by cutting through the rectangular area 252 so as to form a stencil. Further, color different from the color of the rectangular area 252 is printed on the numeral 253 so as to provide a contrast of the numeral 253 to other portions of the sleeve 25. The rectangular areas 242 and 252 have different colors. This embodiment has the same advantages as the above one.

Figure 10:
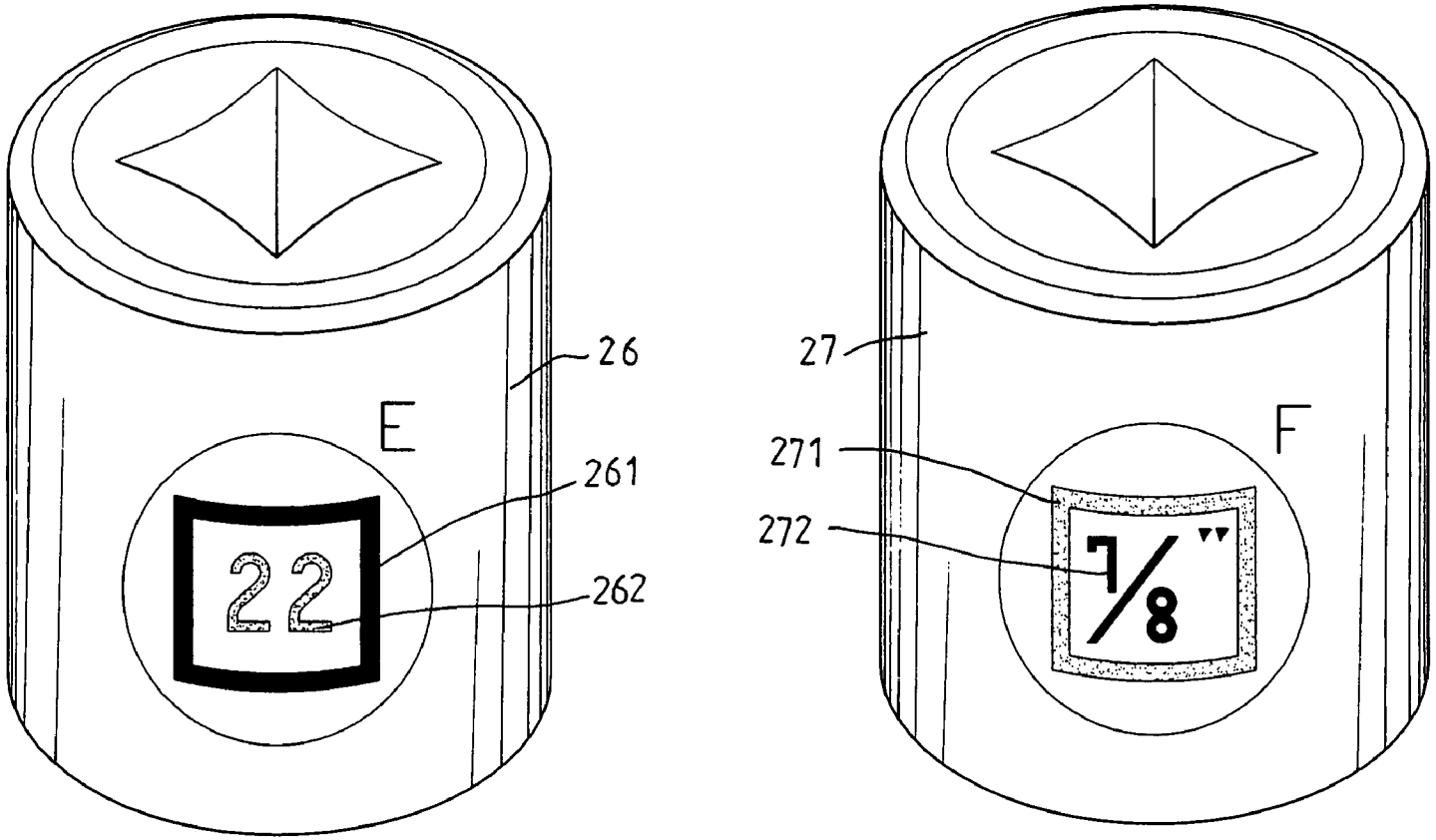
FIG. 10 is a perspective view of two exemplary examples of tool having an arrangement for easily identifying a size thereof according to a fifth preferred embodiment of the invention.
Figure 11:
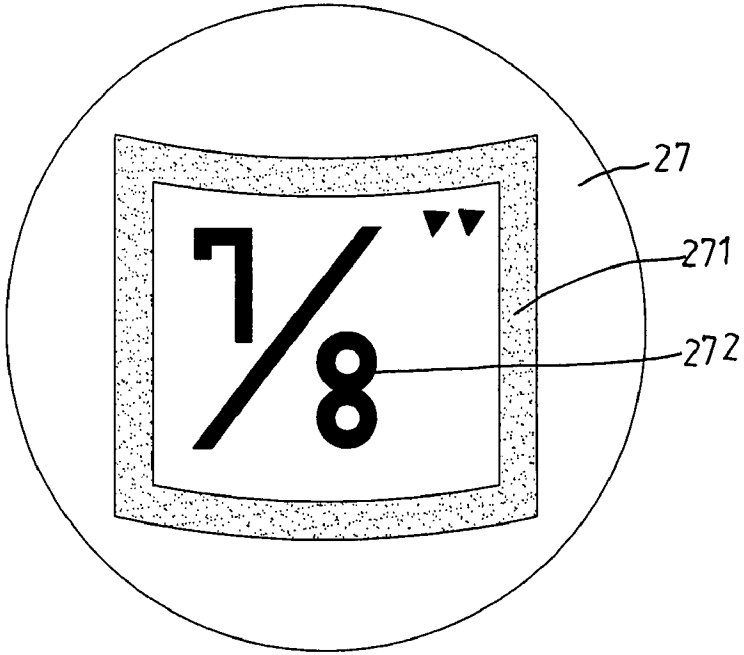
FIG. 11 is a detailed view of the areas in circles E and F in FIG. 10.
Figure 11:
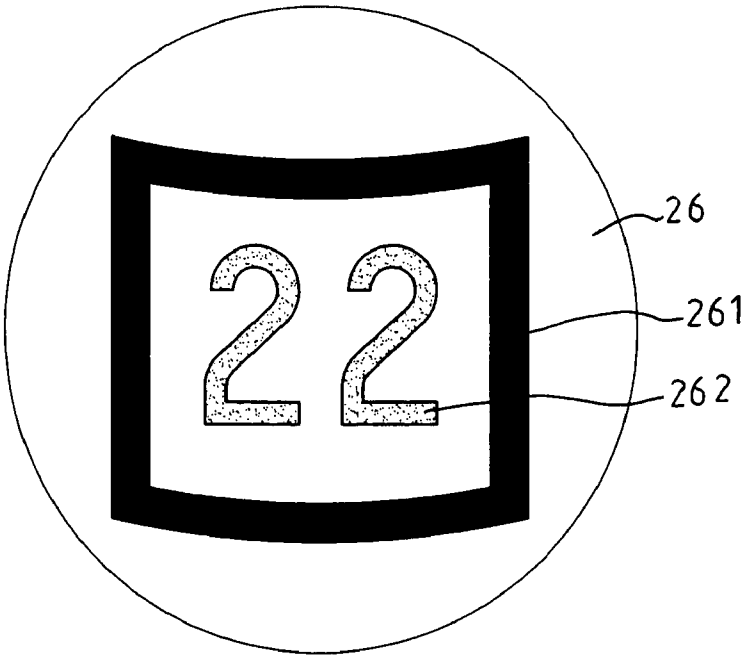

Referring to FIGS. 10 and 11, there is shown a tool (e.g., sleeve) having an arrangement for easily identifying a size thereof in accordance with a fifth preferred embodiment of the invention. A hollow rectangle 261 having a color different from that of the remaining portion of the sleeve 26 of the metric system is embossed on an outer surface of the sleeve 26. A numeral 262 (e.g., 22 as shown) is printed within the rectangle 261. The numeral 262 has a color different from that of the rectangle 261 and that of the sleeve 26 so as to provide a contrast of the numeral 262 to other portions of the sleeve 26. Likewise, a hollow rectangle 271 having a color different from that of the remaining portion of the sleeve 27 of the British system is embossed on an outer surface of the sleeve 27. A numeral 272 (e.g., ⅞" as shown) is printed within the rectangle 271. The numeral 272 has a color different from that of the rectangle 271 and that of the sleeve 27 so as to provide a contrast of the numeral 272 to other portions of the sleeve 27. This embodiment has the same advantages as the above one.

Figure 12:
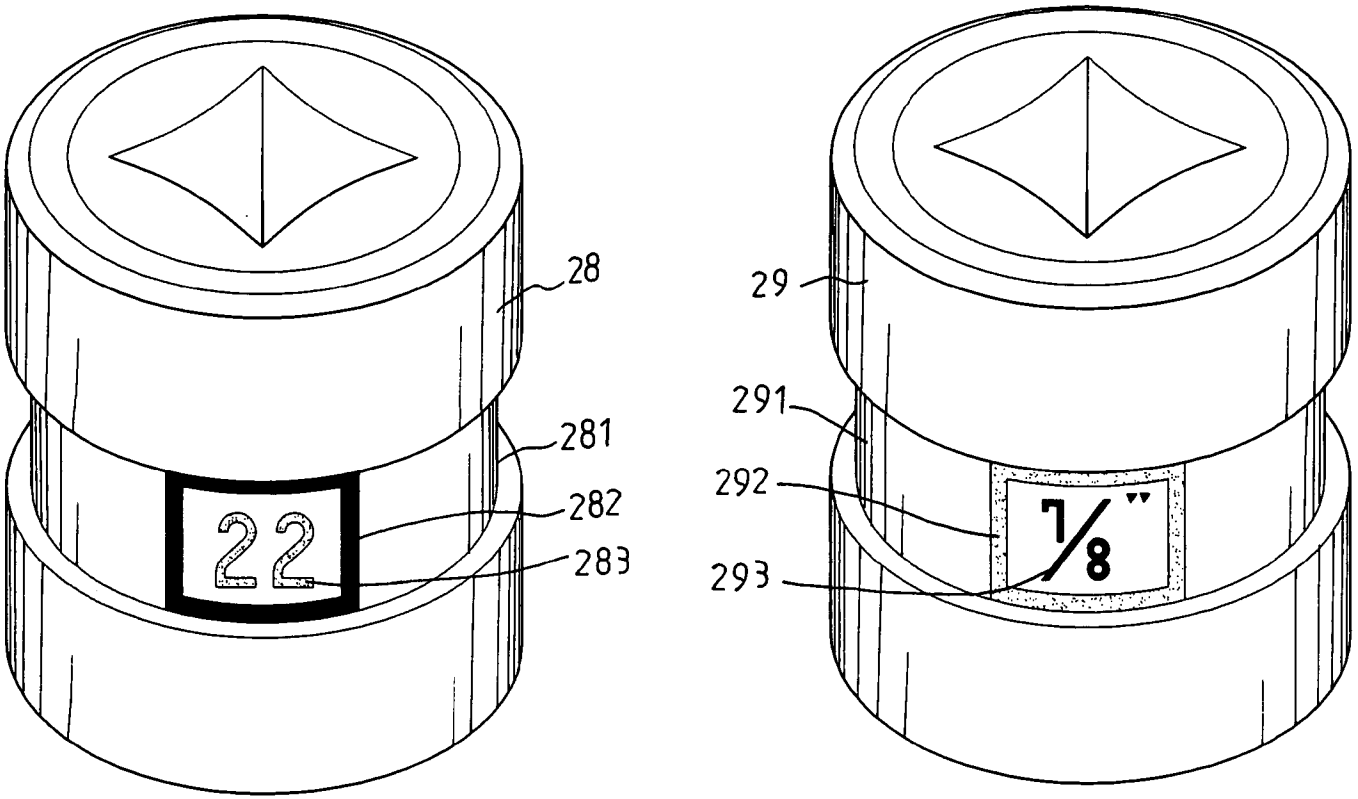
FIG. 12 is a perspective view of two exemplary examples of tool having an arrangement for easily identifying a size thereof according to a sixth preferred embodiment of the invention.

Referring to FIG. 12, there is shown a tool (e.g., sleeve) having an arrangement for easily identifying a size thereof in accordance with a sixth preferred embodiment of the invention. An annular recess 281 is formed around the sleeve 28 of the metric system. A hollow rectangle 282 having a color different from that of the remaining portion of the sleeve 28 is embossed on a portion of the recess 281. A numeral 283 (e.g., 22 as shown) is printed within the rectangle 282. The numeral 283 has a color different from that of the rectangle 282 and that of the sleeve 28 so as to provide a contrast of the numeral 283 to other portions of the sleeve 28. Likewise, an annular recess 291 is formed around the sleeve 29 of the British system. A hollow rectangle 292 having a color different from that of the remaining portion of the sleeve 29 is embossed on a portion of the recess 291. A numeral 293 (e.g., ⅞" as shown) is printed within the rectangle 292. The numeral 293 has a color different from that of the rectangle 292 and that of the sleeve 29 so as to provide a contrast of the numeral 293 to other portions of the sleeve 29. This embodiment has the same advantages as the above one.

Figure 13:
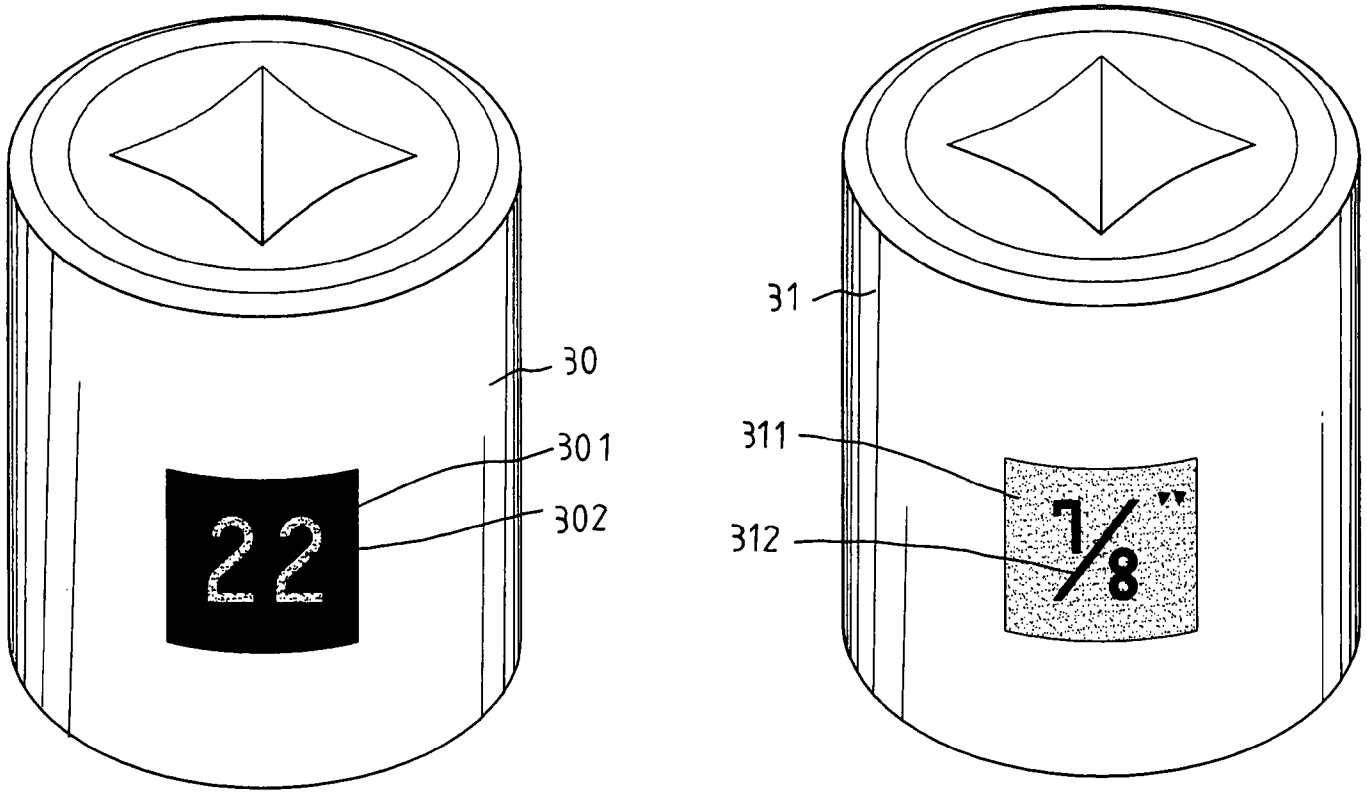
FIG. 13 is a perspective view of two exemplary examples of tool having an arrangement for easily identifying a size thereof according to a seventh preferred embodiment of the invention.

Referring to FIG. 13, there is shown a tool (e.g., sleeve) having an arrangement for easily identifying a size thereof in accordance with a seventh preferred embodiment of the invention. A rectangular area 301 having a color different from that of the remaining portion of the sleeve 30 of the metric system is printed on an outer surface of the sleeve 30. A numeral 302 (e.g., 22 as shown) is printed on the rectangular area 301. The numeral 302 has a color different from that of the rectangular area 301 so as to provide a contrast of the numeral 302 to other portions of the sleeve 30. Likewise, a rectangular area 311 having a color different from that of the remaining portion of the sleeve 31 of the British system is printed on an outer surface of the sleeve 31. A numeral 312 (e.g., ⅞" as shown) is printed on the rectangular area 311. The numeral 312 has a color different from that of the rectangular area 311 and that of the sleeve 31 so as to provide a contrast of the numeral 312 to other portions of the sleeve 31. This embodiment has the same advantages as the above one.

Figure 14:
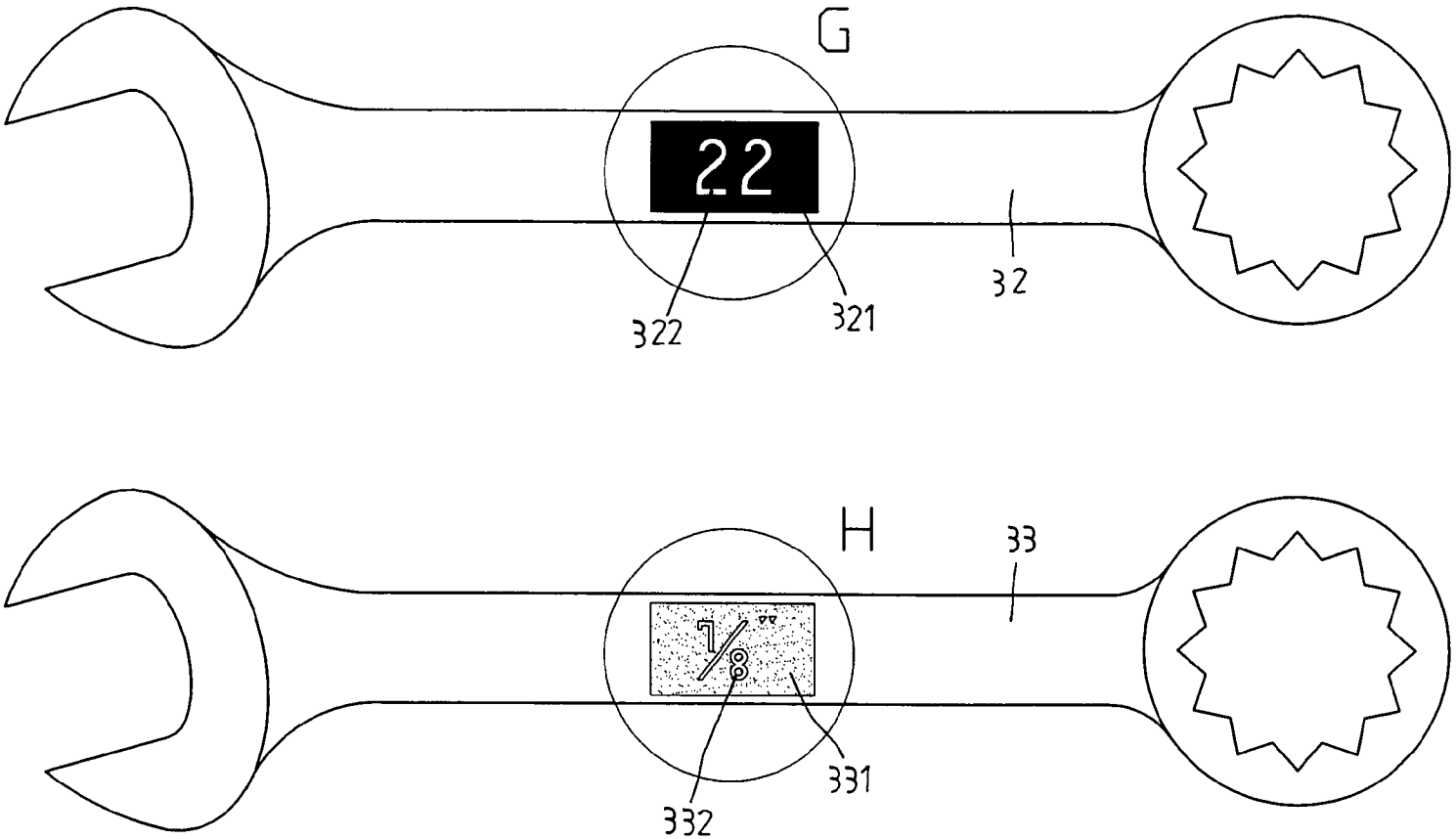
FIG. 14 is a perspective view of two exemplary examples of tool having an arrangement for easily identifying a size thereof according to an eighth preferred embodiment of the invention.
Figure 15:
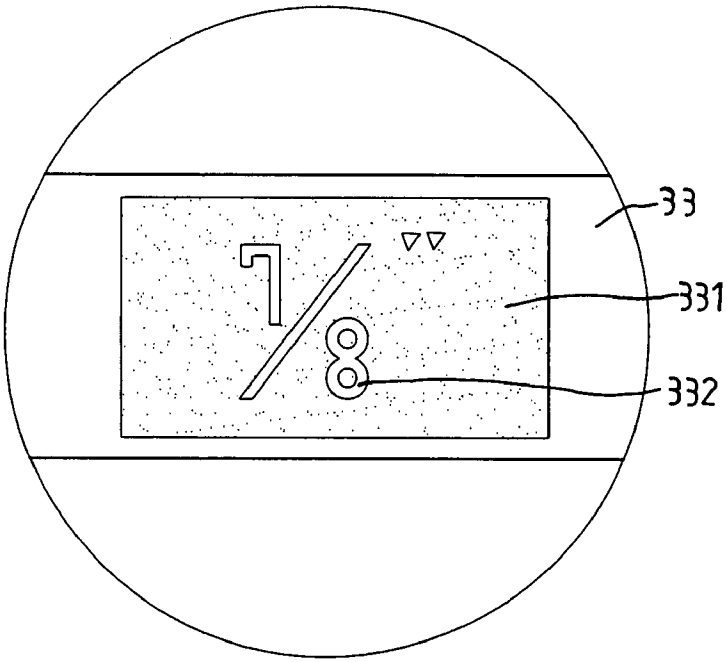
FIG. 15 is a detailed view of the areas in circles G and H in FIG. 14.
Figure 15:
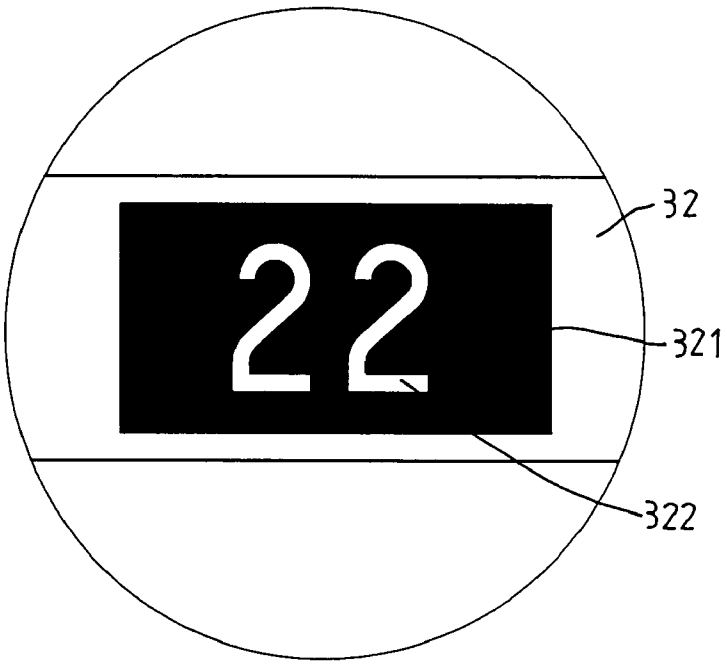

Referring to FIGS. 14 and 15, there is shown a tool (e.g., combination box and open end wrench) having an arrangement for easily identifying a size thereof in accordance with an eighth preferred embodiment of the invention. A rectangular area 321 having a color different from that of the remaining portion of the wrench 32 of the metric system is printed on a handle of the wrench 32. A numeral 322 (e.g., 22 as shown) is formed by cutting through the rectangular area 321 so as to form a stencil for exposing the color of the metal wrench 32 and providing a contrast of the numeral 322 to other portions of the wrench 32. Likewise, a rectangular area 331 having a color different from that of the remaining portion of the wrench 33 of the British system is printed on a handle of the wrench 33. A numeral 332 (e.g., ⅞" as shown) is formed by cutting through the rectangular area 331 so as to form a stencil for exposing the color of the metal wrench 33 and providing a contrast of the numeral 332 to other portions of the wrench 33. This embodiment has the same advantages as the above one.

Figure 16:
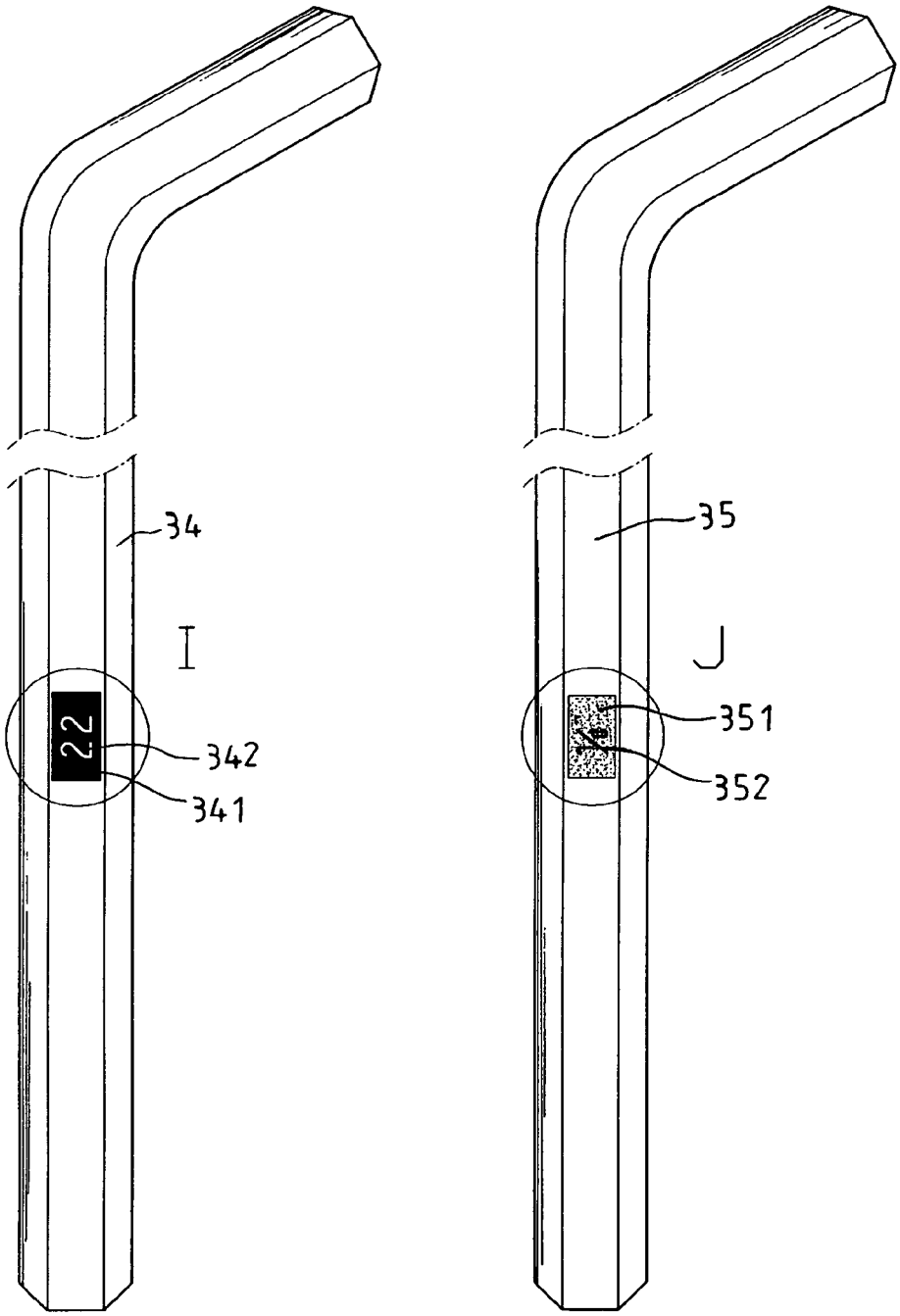
FIG. 16 is a perspective view of two exemplary examples of tool having an arrangement for easily identifying a size thereof according to a ninth preferred embodiment of the invention.
Figure 17:
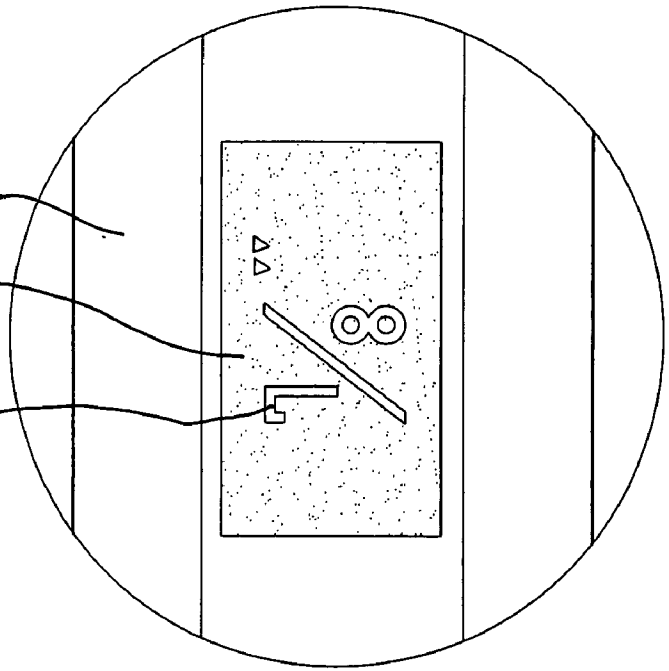
FIG. 17 is a detailed view of the areas in circles I and J in FIG. 16.
Figure 17:
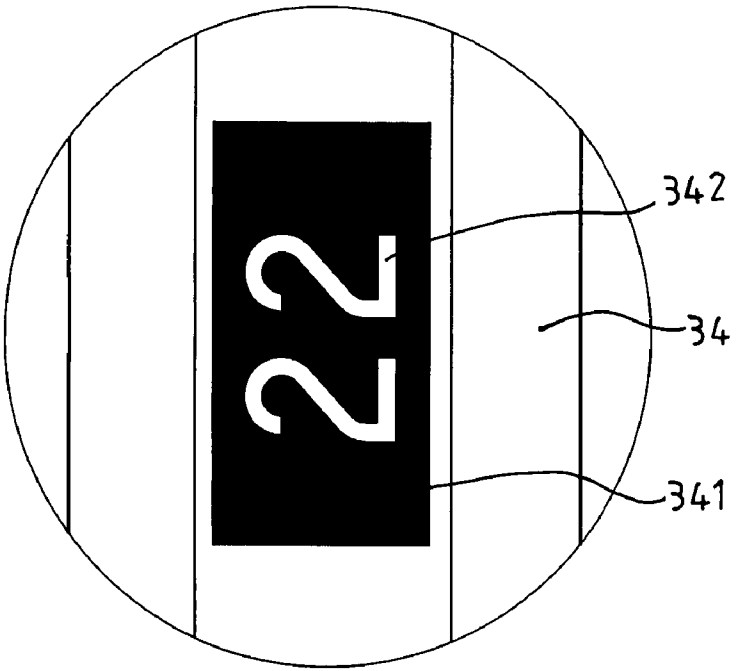

Referring to FIGS. 16 and 17, there is shown a tool (e.g., 6-point wrench) having an arrangement for easily identifying a size thereof in accordance with a ninth preferred embodiment of the invention. A rectangular area 341 having a color different from that of the remaining portion of the wrench 34 of the metric system is printed on a handle of the wrench 34. A numeral 342 (e.g., 22 as shown) is formed by cutting through the rectangular area 341 so as to form a stencil for exposing the color of the metal wrench 34 and providing a contrast of the numeral 342 to other portions of the wrench 34. Likewise, a rectangular area 351 having a color different from that of the remaining portion of the wrench 35 of the British system is printed on a handle of the wrench 35. A numeral 352 (e.g., ⅞" as shown) is formed by cutting through the rectangular area 351 so as to form a stencil for exposing the color of the metal wrench 35 and providing a contrast of the numeral 352 to other portions of the wrench 35. This embodiment has the same advantages as the above one.

Figure 18:
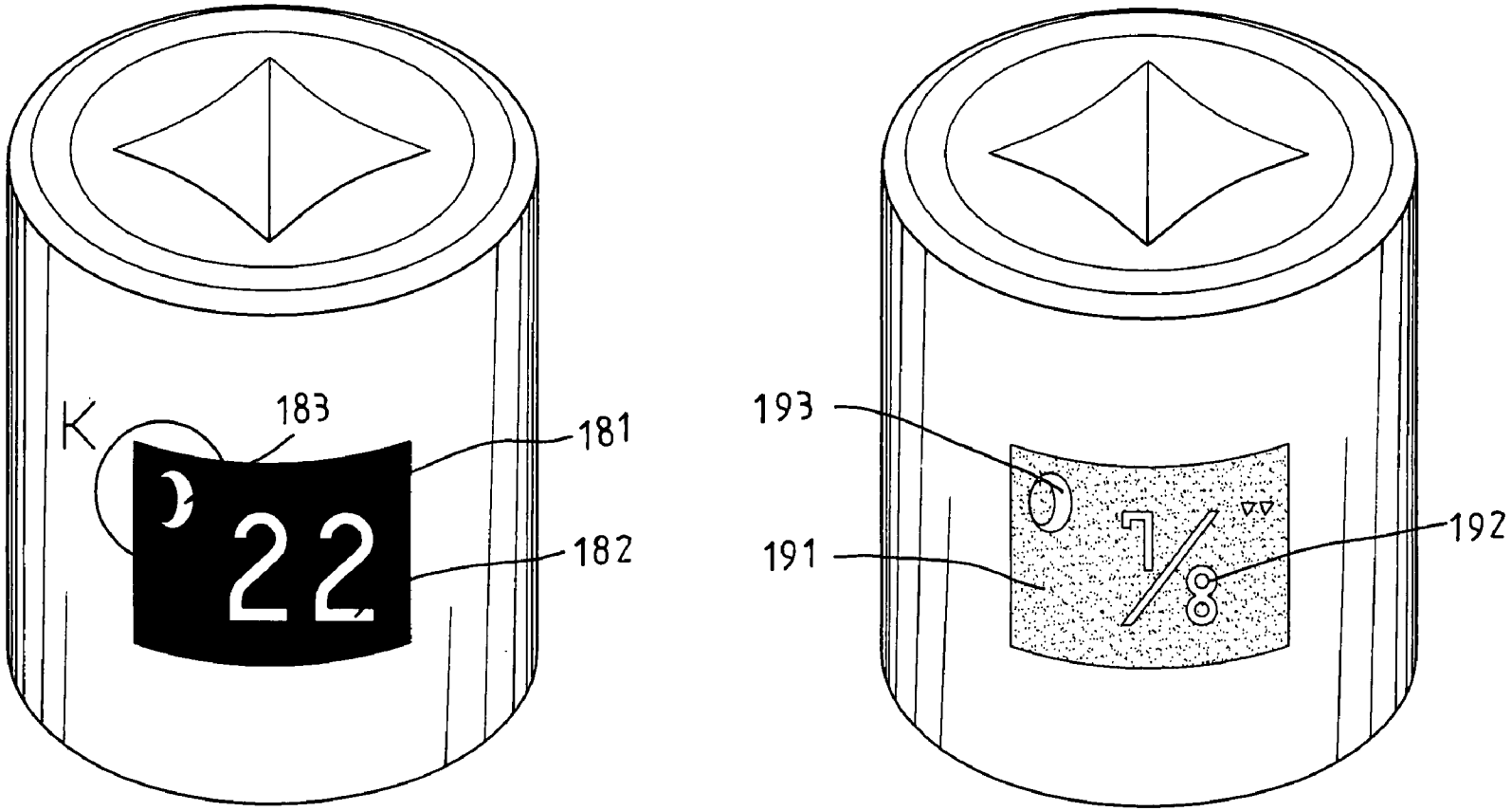
FIG. 18 is a perspective view of two exemplary examples of tool having an arrangement for easily identifying a size thereof according to a tenth preferred embodiment of the invention.
Figure 19:
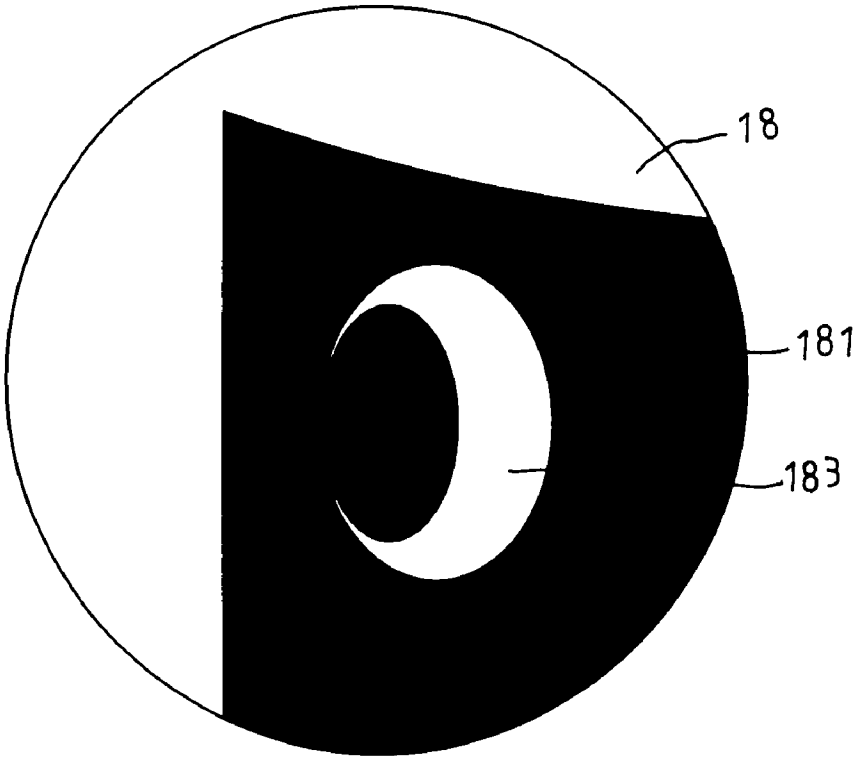
FIG. 19 is a detailed view of the area in circle K in FIG. 18.

Referring to FIGS. 18 and 19, there is shown a tool (e.g., sleeve) having an arrangement for easily identifying a size thereof in accordance with a tenth preferred embodiment of the invention. The tenth embodiment substantially has same structure and advantages as the first embodiment. The additional characteristic of the tenth embodiment is detailed below. Trademarks 183 and 193 are carved on left top corners of the rectangular areas 181 and 191 respectively for product distinguishing purpose.

While the invention herein disclosed has been described by means of specific embodiments, numerous modifications and variations could be made thereto by those skilled in the art without departing from the scope and spirit of the invention set forth in the claims.

What is claimed is:

1. A tool, said tool having a cylindrical outer surface and comprising:

a curved area rectangle formed on said cylindrical outer surface of said tool; and an identification mark formed on said curved rectangle as a representation of a size of said tool;

wherein said curved rectangle and said identification mark are colored with first and second colors, respectively, said first and second colors are different from each other, at least said first color is different from said tool itself.

2. The tool of claim 1, wherein identification mark in said curved rectangle is formed by cutting through said curved rectangle so as to form a stencil for exposing a metal color of the tool and providing a contrast of the numeral to other portions of the area.

3. The tool of claim 2, further comprising an annular recess formed on said outer surface of said tool with both curved rectangle and said identification mark printed thereon.

4. The tool of claim 2, further comprising a trademark formed by cutting through said curved rectangle so as to form a stencil.

5. The tool of claim 1, wherein said identification mark is formed by cutting through the curved rectangle, so as to form a stencil and said second color is formed by printing so as to provide a contrast of the identification mark to other portions of the area.

6. The tool of claim 5, further comprising an annular recess formed on said cylindrical outer surface of said tool with both said curved rectangle and said identification mark printed thereon.

7. The tool of claim 1, wherein said curved rectangle is hollow to form an enclosed embossment with said identification mark in the hollow portion for exposing a metal color of the tool and providing a contrast of said identification mark relative to other portions of said curved rectangle.

8. The tool of claim 7, further comprising an annular recess formed on said cylindrical outer surface of the said tool with the embossment formed thereon and the numeral printed in the hollow portion.

9. The tool of claim 1, wherein both said curved rectangle and said identification mark are formed by printing in different colors.

10. The tool of claim 1, wherein different first colors are used for British system and for metric system, respectively.

11. A set of tools containing a mixture of tools of British and metric systems, each of said tools having a cylindrical outer surface and comprising:

a curved rectangle formed on an cylindrical outer surface of said tool; and an identification mark formed on said curved rectangle as a representation of a size of said tool;

wherein said curved rectangle and said identification mark have different colors, and said curved rectangle has a first color for British system and a second color for metric system, further wherein said first and second colors are different from each other, and both are different from a color of said tool itself.

* * * * *